US008151782B2

(12) United States Patent
Huang

(10) Patent No.: US 8,151,782 B2
(45) Date of Patent: Apr. 10, 2012

(54) BASEBALL BATTING PRACTICE EQUIPMENT

(75) Inventor: Ching-Shu Huang, Tainan (TW)

(73) Assignee: Hern Juie Co., Ltd., Tainan (TW)

( * ) Notice: Subject to any disclaimer, the term of this patent is extended or adjusted under 35 U.S.C. 154(b) by 302 days.

(21) Appl. No.: 12/704,378

(22) Filed: Feb. 11, 2010

(65) Prior Publication Data

US 2011/0192384 A1 Aug. 11, 2011

(51) Int. Cl.
*F41B 7/00* (2006.01)
*F41B 3/03* (2006.01)

(52) U.S. Cl. ..... 124/16; 124/36

(58) Field of Classification Search ..... 124/16, 124/33, 34, 36, 37
See application file for complete search history.

(56) References Cited

U.S. PATENT DOCUMENTS 1,912,360 A * 6/1933 Blanchard ..... 124/7
3,084,680 A * 4/1963 Goldfarb et al. ..... 124/16
4,282,848 A * 8/1981 Kulesza et al. ..... 124/16
4,865,318 A * 9/1989 Lehmann et al. ..... 124/16
6,089,215 A * 7/2000 Morris et al. ..... 124/16
6,647,975 B2 * 11/2003 Whitfield ..... 124/16
6,875,136 B2 * 4/2005 Leal et al. ..... 473/451
7,748,367 B2 * 7/2010 Kosjer ..... 124/16

* cited by examiner

*Primary Examiner* — John Ricci
(74) *Attorney, Agent, or Firm* — J.C. Patents

(57) ABSTRACT

A baseball batting practice equipment includes a base provided with a movable member controlled to operate by the retaining post of a ball pitching speed adjustment device that is disposed with bevel gears and an actuating member for regulating the speed of ball pitching. An elastic member has opposite sides respectively secured with the movable member and the base for assisting the movable member to recover its original position. The base is further provided with a hooking member for holding an elastic plate and, after the movable member touches the hooking member, releasing the elastic plate for pitching balls. A ball pitching apparatus is provided with an elastic member for adjusting and delaying time of ball pitching, a gear unit and an actuating rod for winding tight or unwinding loose the elastic member. A power unit with a pedal is to carry out pitching balls.

22 Claims, 10 Drawing Sheets

BASEBALL BATTING PRACTICE EQUIPMENT

BACKGROUND OF THE INVENTION

1. Field of the Invention

This invention relates to a baseball batting practice equipment, particularly to one able to automatically pitch balls for a batter to practice batting anytime according to time set for ball pitching after the batter stands firm at a batting position.

2. Description of the Prior Art

At present, a baseball batting practice apparatus, as disclosed in a Taiwan patent, No. 574935, titled "BASEBALL PITCHING APPARATUS", is to have an elastic plate actuated by an elastic member to turn up elastically and pitch balls and is provided with a delay unit for delaying pitching balls. However, since the ball pitching position is unchangeable; therefore, it is inconvenient for batters with different heights to practice batting baseballs.

Another baseball batting practice apparatus, as disclosed in a U.S. Pat. No. 1,912,360, is to employ an elastic plate for supplying and pitching practice balls without providing any delay unit for lowering velocity of ball pitching and as a result, the batting practice apparatus may pitch balls even before a batter stands firm at a batting position.

SUMMARY OF THE INVENTION

The objective of this invention is to offer a baseball batting practice equipment by which a batter can freely self-practice batting balls anytime, needless to have another person pitching balls.

The baseball batting practice equipment of this invention includes a base provided with a movable member having a lower side fixed with one end of an elastic member that has another end secured with the base. The elastic member functions to help the movable member to recover its original position to let the movable member controlled to operate by a retaining post of a ball pitching speed adjusting device. The base is disposed with a hooking member for holding an elastic plate and releasing the elastic plate for pitching balls after the movable member touches the hooking member.

The baseball batting practice equipment of this invention is provided with a ball pitching apparatus, a spring-shaped elastic member and a gear unit. The ball pitching apparatus consists of a left shell and a right shell for accommodating all the members of the ball pitching apparatus. The spring-shaped elastic member functions to adjust and delay time of ball pitching. The gear unit is composed of a plurality of gears engaged mutually for winding tight or unwinding the spring-shaped elastic member by mutual operation of a rack and an actuating rod.

The ball pitching apparatus of the baseball batting practice equipment in the present invention is disposed with a ball pitching speed adjusting device containing a first bevel gear and a second bevel gear engaged with each other. The second bevel gear is positioned in the interior of an actuating member that is formed with a protruding-out portion and a circular portion. A driving rod is assembled under the actuating member and has one end fixed with a retaining post. An elastic member is mounted at the topside of the retaining post that has one side cut with a notch for the driving rod to be extended therein.

The ball pitching apparatus of the baseball batting practice equipment of this invention has a power unit provided with an actuating rod to be inserted through one end of two connecting rods and the elongate hole of an upper cover and also through the insert hole of the rack. The connecting rods of the power unit have another end pivotally fixed with the shaft rods of a pedal, and a press rod is inserted through the pedal. The power unit is further provided with an elastic plate to be operated together with the hooking member for pitching balls.

The baseball batting practice equipment of this invention further includes an upper cover disposed with a ball pitching hole for depositing practice balls therein.

Thus, the baseball batting practice equipment in the present invention can automatically pitch balls for a batter to practice batting freely.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
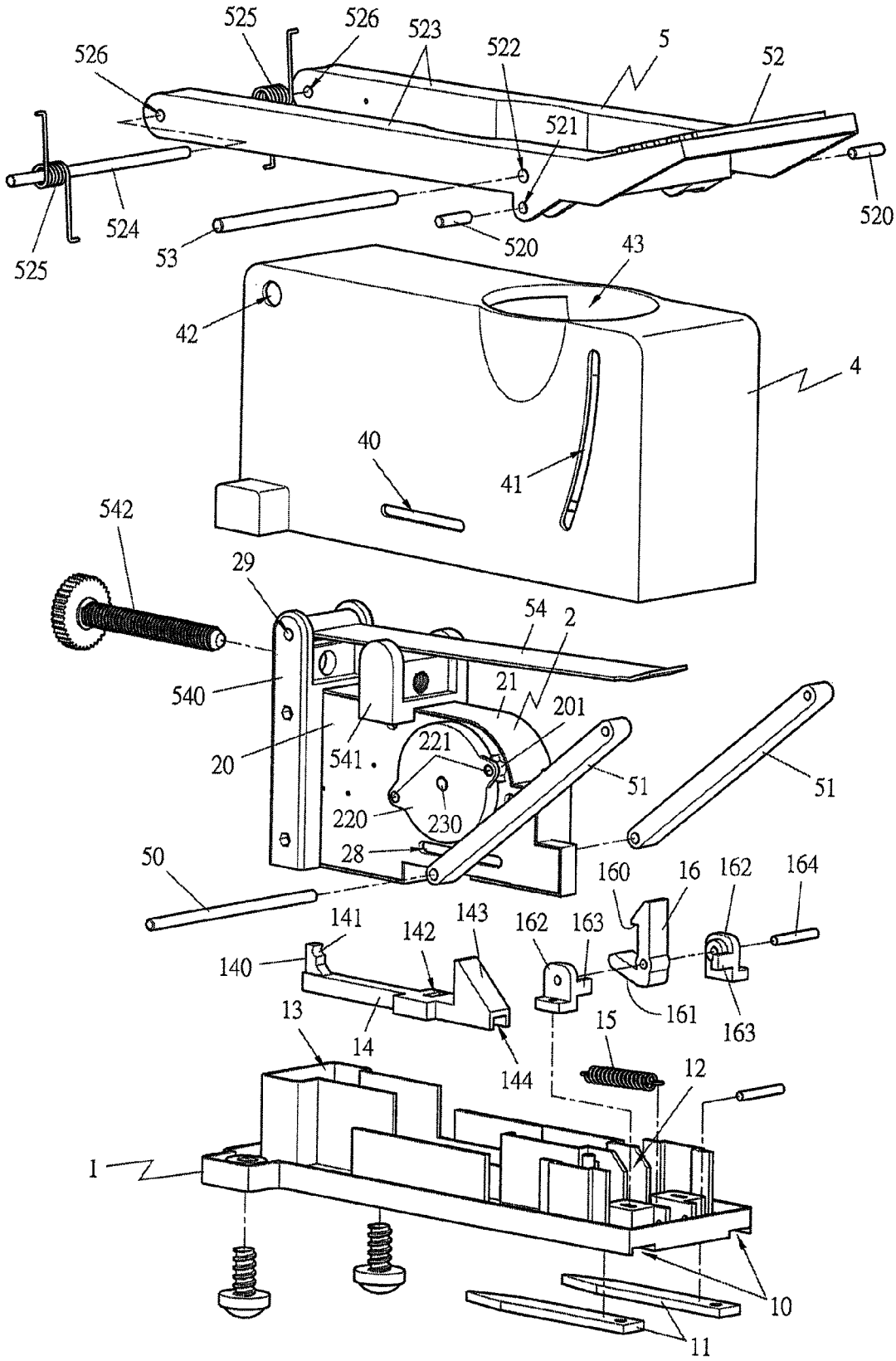
FIG. 1 is an exploded perspective view of a baseball batting practice equipment in the present invention.
Figure 2:
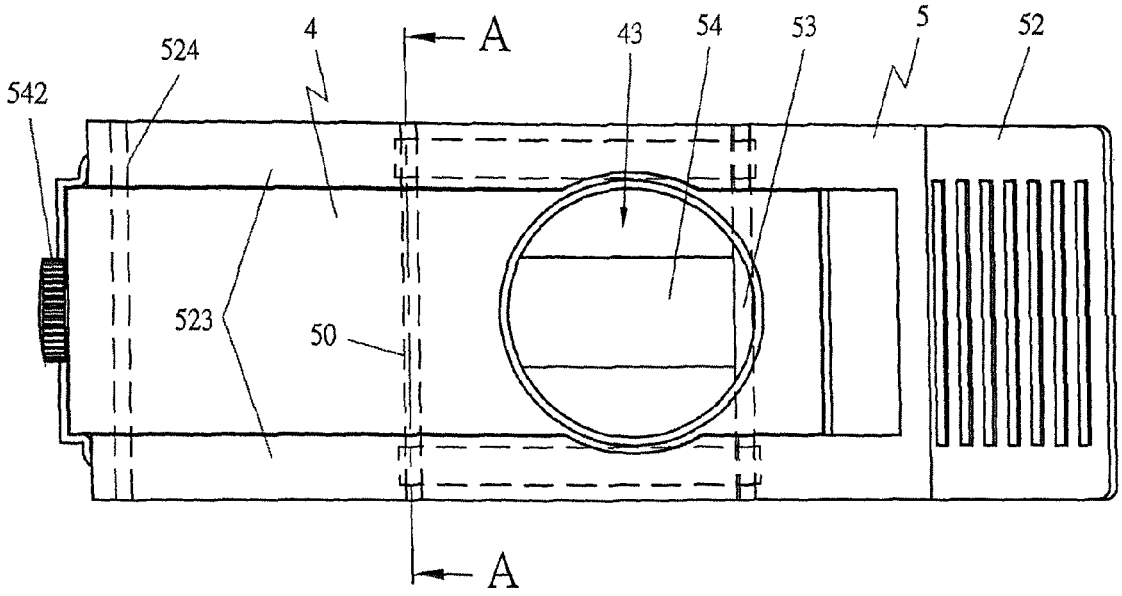
FIG. 2 is an upper view of the baseball batting practice equipment in the present invention.

A preferred embodiment of a baseball batting practice equipment in the present invention, as shown in FIGS. 1 and 2, includes a base 1, a ball pitching apparatus 2, a ball pitching speed adjusting device 3, a power unit 4 and an upper cover 5 as main components combined together.

Figure 8:
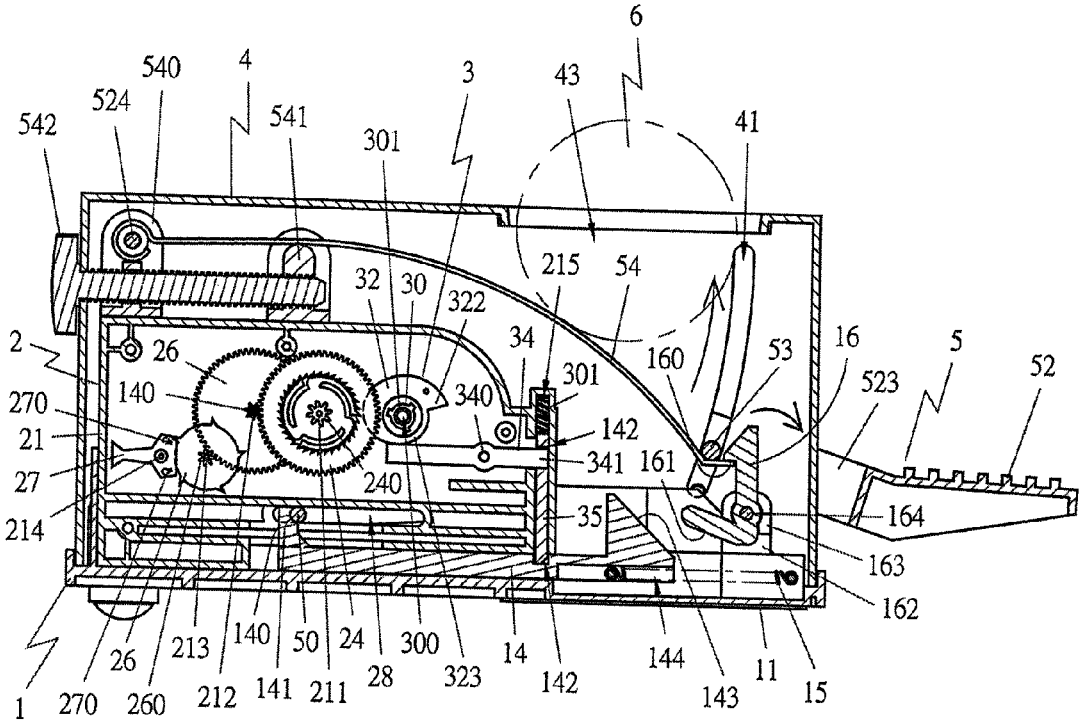
FIG. 8 is a cross-sectional view of FIG. 7.
Figure 9:
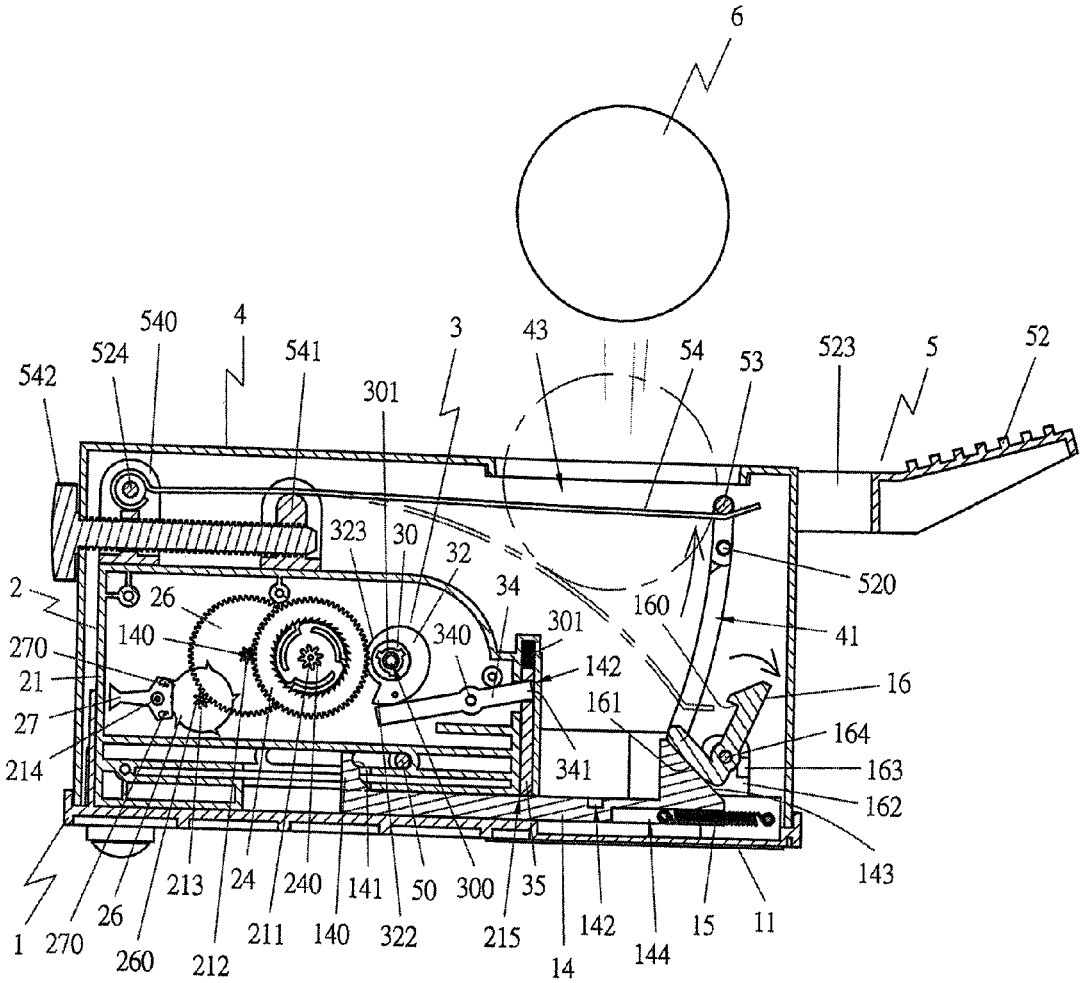
FIG. 9 is a cross-sectional view of the baseball batting practice equipment in a ball pitching condition in the present invention.

The base 1 has its lower side provided with one or more long grooves 10 for receiving same-number extensible plates 11, which can be pulled outward to be fixed on the ground for stabilizing the batting practice equipment on the ground. The base 1 has its upper side disposed with a plurality of different grooves 12, 13 respectively for installing a movable member 14 and a ball pitching apparatus 2 therein. The movable member 14 has its rear side formed with a protruding-up actuating base 140 having one side provided with a plurality of arcuate recesses 141 for an actuating rod 50 to operate therein and shift the movable member 14. In addition, the movable member 14 is provided with a fitting groove 142 for placing therein a retaining post 35 of the ball pitching apparatus 2 so that the retaining post 35 may fix the movable member 14 at a proper position, further having its front side formed with a slanting push surface 143 to be correspondingly operated with a hooking member 16 and its lower side bored with an accommodating groove 144. The base 1 is further provided with an elastic member 15 having one end fixed in the accommodating groove 144 of the moveable member 14 and another end secured at a proper location of the base 1, as shown in FIGS. 8 and 9, for helping the movable member 14 to recover its original position. The hooking member 16 of the base 1 is provided with a retaining surface 160 for holding an elastic plate 54 of the ball pitching apparatus 2 and formed with a push surface 161 to match with the push surface 143 of the movable member 14 for operating mutually. When the movable member 14 is drawn back by the elastic member 15 and has its push surface 143 touching the push surface 161 of the hooking member 16, the hooking member 16 will be turned over to let go of the elastic plate 54 of ball pitching apparatus 2 to enable the elastic plate 54 to pitch balls, as shown in FIG. 9. Moreover, the hooking member 16 has its opposite sides respectively disposed with a fixing base 162, with a pivot 164 inserted through the hooking member 16 and the two fixing bases 162 to enable the hooking member 16 to turn over, and each fixing base 162 has its rear side formed with a stop block 163 for restricting the angles of turning over of the hooking member 16.

Figure 3:
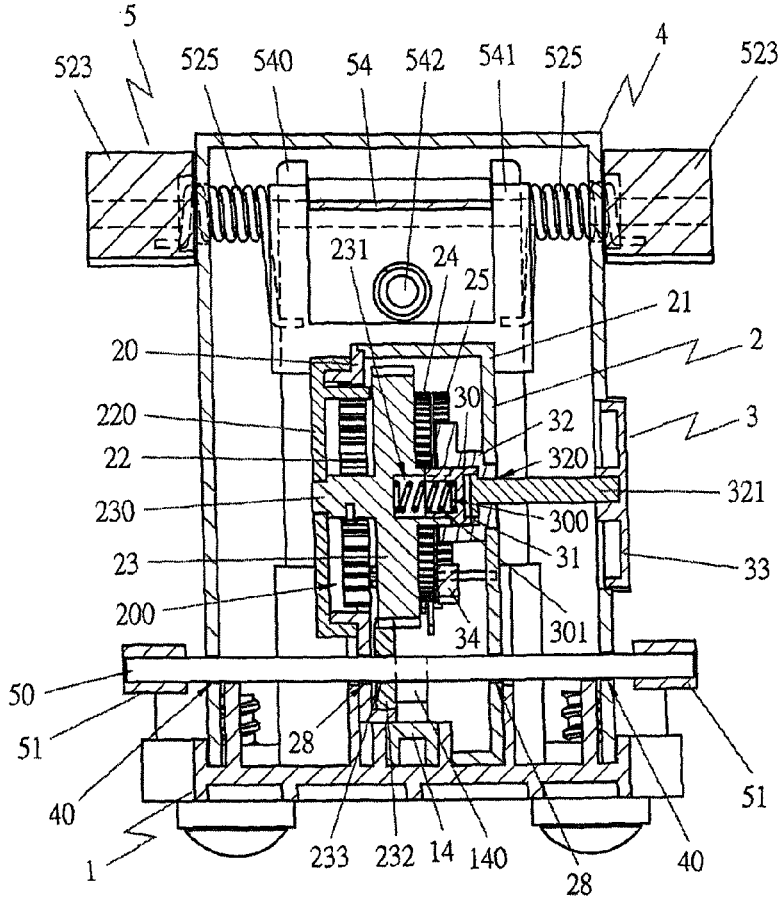
FIG. 3 is a cross-sectional view of the line A-A in FIG. 2.

The ball pitching apparatus 2, as shown in FIGS. 3-6, is provided with a left shell 20 and a right shell 21 combined together for accommodating all the members of the ball pitching apparatus 2. The left shell 20 is bored with an opening 200 for receiving a spring-shaped elastic member 22 and provided with two bolt seats 201 at the opposite outer sides of the opening 200 for a side cover 220 to be threadably fixed thereon by bolts 221 and thus, one end of the spring-shaped elastic member 22 can be fixed by the inner side of the side cover 220, as shown in FIG. 3.

Figure 4:
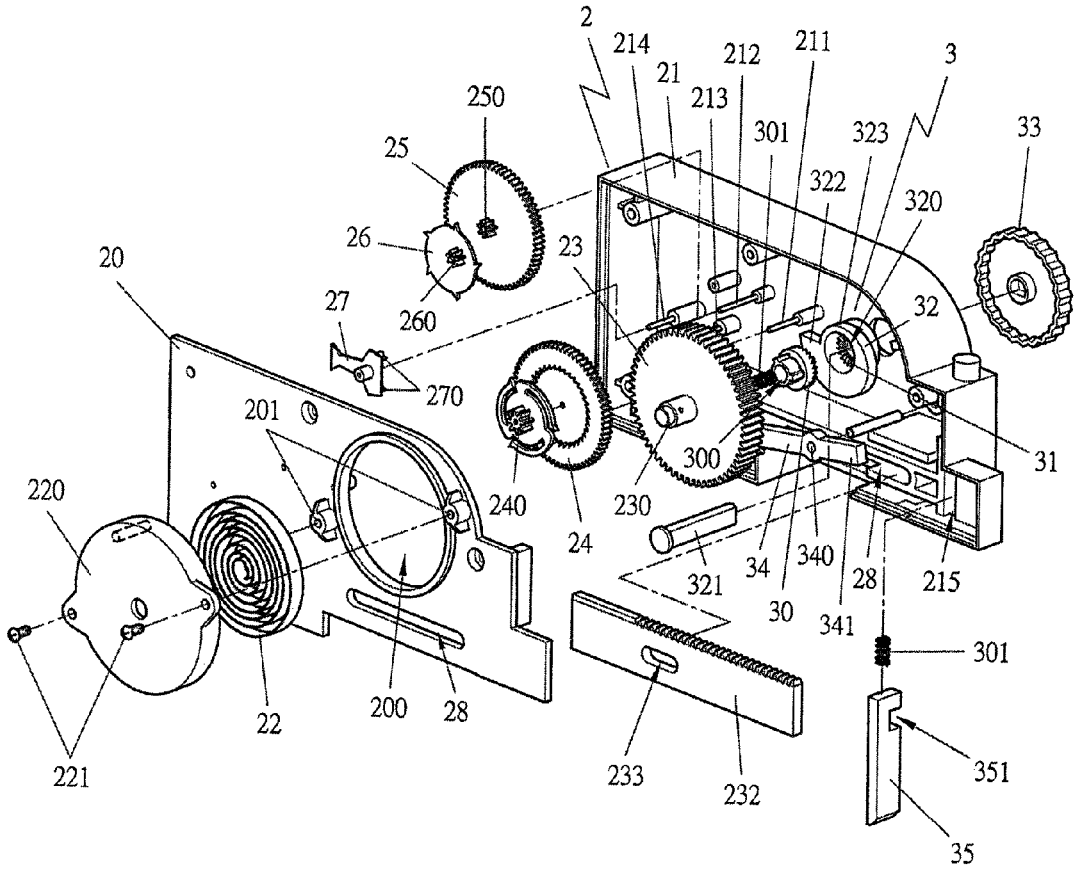
FIG. 4 is an exploded perspective view of a ball pitching apparatus in the present invention.
Figure 6:
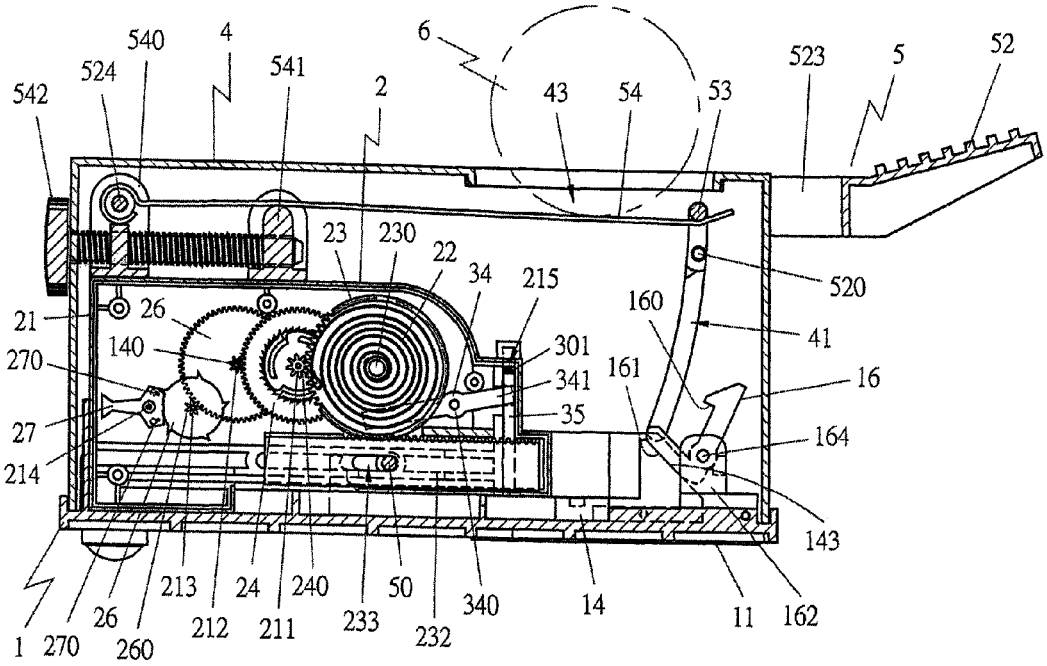
FIG. 6 is a cross-sectional view of FIG. 5.

Referring to FIGS. 3 and 4, the ball pitching apparatus 2 is disposed with a gear unit consisting of a first gear 23, a second gear 24, a third gear 25 and a fourth gear 26, which are engaged with one another mutually. The first gear 23 has one side provided with a shaft 230 for fixing another end of the spring-shaped elastic member 22, as shown in FIGS. 3 and 6. Thus, the spring-shaped elastic member 22 can be driven by the gear unit to be wound tight or unwound loose. The first gear 23 has another side bored with a groove 231 for fixing a first bevel gear 30 of the ball pitching speed adjusting device 3, with the first bevel gear 30 serving as a fulcrum of the first gear 23, and further has its underside engaged with a rack 232 that is bored with an insert hole 233 for an actuating rod 50 to be inserted therein. The second gear 24 is pivotally assembled on a second shaft 211 of the right shell 21, provided with a pinion gear 240 engaged with the first gear 23. The third gear 25 is pivotally mounted on a third shaft 212 of the right shell 21, having a pinion gear 250 engaged with the second gear 24, and the fourth gear 26 is pivotally fitted on a fourth shaft 213 of the right shell 21, disposed with a pinion gear 260 engaged with the third gear 25 and formed with only a few teeth set apart for actuating a slow-acting block 27 to turn to one side. The slow-acting block 27 is pivotally assembled on a fifth shaft 214 of the right shell 21, having an upper and a lower inner side respectively formed with a projection 270 to be moved by the teeth of the fourth gear 26 so as to produce some little resistance to achieve effect analogous to buffer. By so designing, when the spring-shaped elastic member 22 is actuated to release torsion, the gear unit can function like a gear shift box to avoid releasing torsion too fast so that a baseball batter may have enough time for adjusting batting postures and positions.

The ball pitching speed adjusting device 3 is provided with the first bevel gear 30 and a second bevel gear 31 engaged with each other. The first bevel gear 30 is bored with a groove 300 communicating with the groove 231 of the first gear 23 for receiving an elastic member 301, which functions to adjust both the engaging tightness of the first bevel gear 30 and the second gear 31 and the reverse-turning speed of the gear unit, as shown in FIG. 3. The second bevel gear 31 is disposed in the interior with an actuating member 32 to be operated together with the actuating member 32. The actuating member 32 has one side bored with a shaft hole 320 for a long pivot 321 to be inserted therethrough. The long pivot 321 inverted-T shaped is inserted into the shaft hole 320 from an inner side and extended out of both the right shell 21 and the upper cover 4 and then secured with a regulating wheel 33. Thus, by operating the regulating wheel 33 to adjust the combination condition of the first and the second bevel gear 30, 31, the actuating member 32 can be changed in position angles for altering ball pitching speed, enabling a user to self-adjust ball pitching time according to practical needs.

Figure 5:
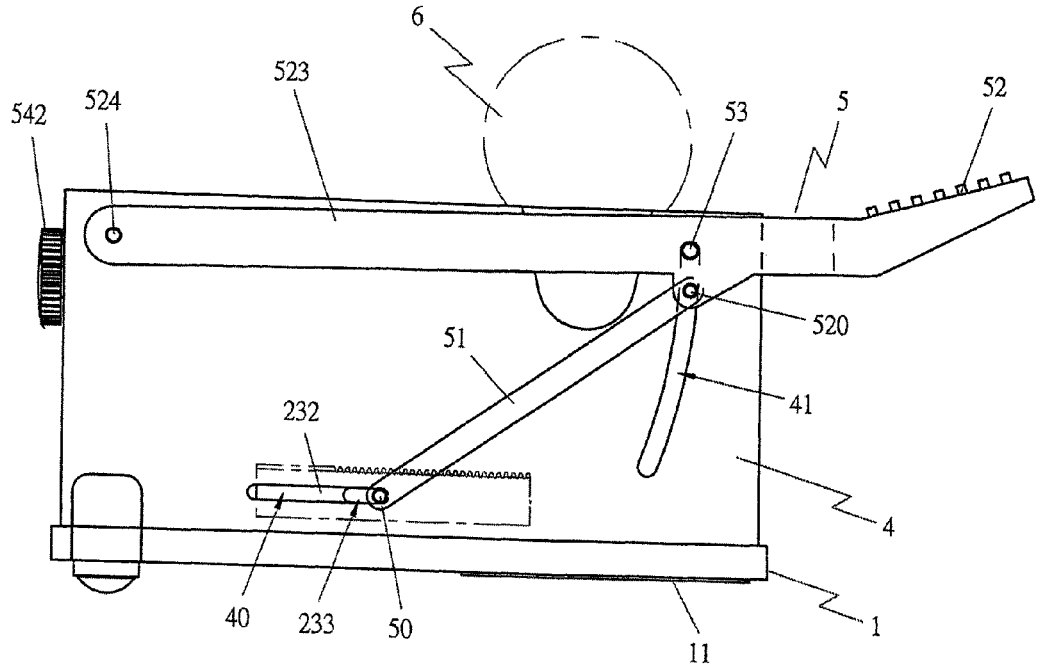
FIG. 5 is a schematic view of the baseball batting practice equipment in a preparatory condition in the present invention.
Figure 7:
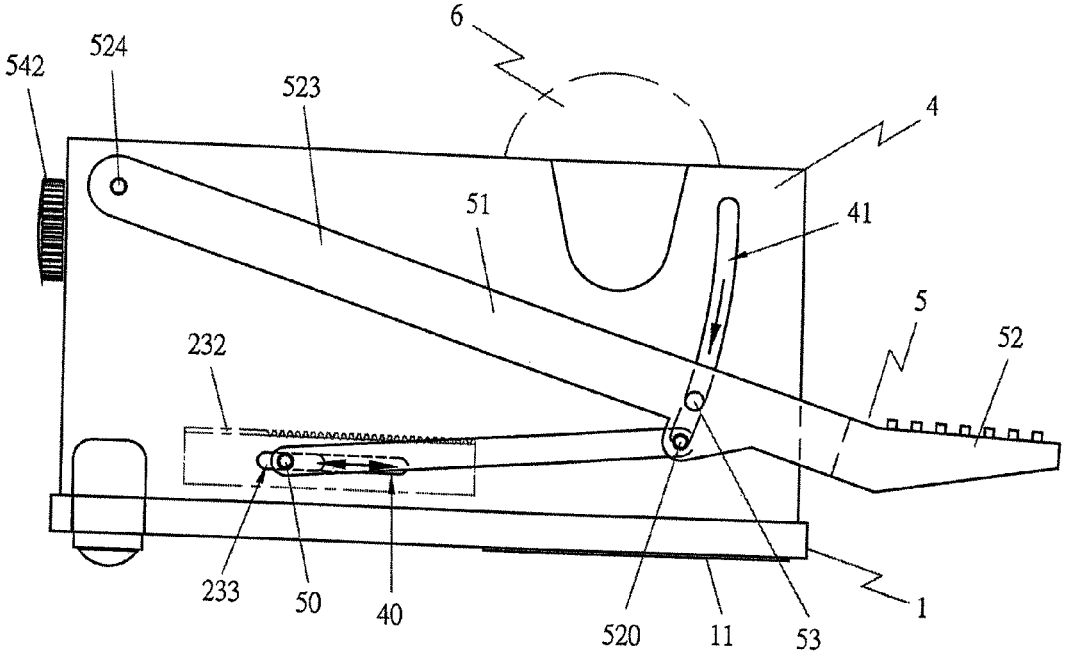
FIG. 7 is a schematic view of the baseball batting practice equipment getting ready to pitch balls in the present invention.

The actuating member 32 is snail-shaped and formed with a comparatively long protruding-out portion 322 and a circular portion 323, as shown in FIGS. 8 and 9. A driving rod 34 is positioned under the actuating member 32 and provided with a fulcrum 340 to produce function of a seesaw, and a retaining post 35 positioned at one side of the driving rod 34 is received in the upright groove 215 of the right shell 21, having its topside assembled with an elastic member 350 and one side cut with a notch 351 for the driving rod 34 to be extended therein. Referring to FIGS. 5 and 6, ordinarily, the end 341 of the driving rod 34 is turned up to actuate the retaining post 35 to move up and keep away from the retaining groove 142 of the movable member 14, enabling the movable member 14 to move freely. But, when the spring-shaped elastic member 22 is wound tight, the gear unit can be rotated reversely, and the circular portion 323 of the actuating member 32 will touch the driving rod 34 and meanwhile the elastic member 350 at the topside of the retaining post 35 will elastically press the retaining post 35 to move downward and keep the driving rod 34 in a horizontal condition, as shown in FIGS. 7 and 8, letting the retaining post 35 engaged in the retaining groove 142 of the movable member 14 and fixing the movable member 14 in position to form a preconditioning state for pitching balls. On the contrary, when the spring-shaped elastic member 22 begins releasing torsion to a certain extent, the gear unit will be driven to rotate in positive direction and the protruding-out portion 322 of the actuating member 32 will be actuated to largely press the driving rod 34 to let the end 341 of the driving rod 34 turn up to drive the retaining post 35 to move upward and keep away from the retaining groove 142 of the movable member 14 to let the movable member 14 drawn back by the elastic member 15 to push the hooking member 16 to turn over and release the elastic plate 54 for pitching balls.

The power unit 5 of the ball pitching apparatus 2 is provided with an actuating rod 50, two connecting rods 51, a pedal 52, a press rod 53 and an elastic plate 54. The actuating rod 50 is inserted through one end of the connecting rods 51 and extended in the slot 40 of the upper cover 4 to produce support effect and then inserted through the slot 28 of the ball-pitching apparatus 2 and the insert hole 233 of the rack 232. The connecting rods 51 respectively have another end pivotally assembled on the shaft rods 520 of the pedal 52 and fixed with the first holes 521 of the pedal 52. The press rod 53 is inserted through two second holes 522 of the pedal 52 and two opposite sides of the curved slots 41 of the upper cover 4 to be positioned between two shanks 523 at the rear side of the pedal 52 and received inside the upper cover 4, letting the pedal 52 fixed at a front upper side of the upper cover 4. The two shanks 523 of the pedal 52 are provided with a pivot 524 fixed thereon with plural torsional spring 525. The pivot 524 is inserted through two holes 526 of the two shanks 523 and two side holes 42 of the upper cover 4 and through the insert hole 29 of the ball-pitching apparatus 2 to enable the pedal 52 to produce pedaling effect. The elastic plate 54 has one end secured at the upper side of both a foundation base 540 and a regulating block 541, and a long bolt 542 is screwed between the foundation base 540 and the regulating block 541 for adjusting the position of the regulating block 541 in order to change the elastic force of the elastic plate 54 for changing ball pitching velocity and height.

The upper cover 4 to be covered on the ball-pitching apparatus 2 is bored with an elongate hole 40 and a curved slot 41 respectively in two opposite sides and has an upper side provided with a ball-pitching opening 43 for placing practice balls 6.

In using and operating, after the practice balls 6 are put in the ball-pitching opening 43 of the upper cover 43 and a batter treads upon the pedal 52 of the power unit 5, the actuating rod 50 will actuate the rack 232 of the gear unit to move to one side and drive the gear unit to rotate and wind tight the spring-shaped elastic member 22. Simultaneously, the movable member 14 will be moved and positioned in place, and the retaining post 35 will be moved down to be engaged in the retaining groove 142 of the movable member 14, making the elastic plate 54 held by the hooking member 16 and letting the batter have time to adjust his standing positions and batting postures. At this time, according to a set condition, the spring-shaped elastic member 22 will gradually release torsion to make the gear unit rotate reversely to make the actuating member 32 of the ball pitching speed adjusting device 3 release the retaining post 35 to let the movable member 14 quickly recover its original position and have its push surface 143 pushing the hooking member 16 to turn over and release the elastic plate 54 to enable the elastic plate 54 to quickly recover its original position and elastically pitch balls out for a batter to bat, as shown in FIG. 9.

Figure 10:
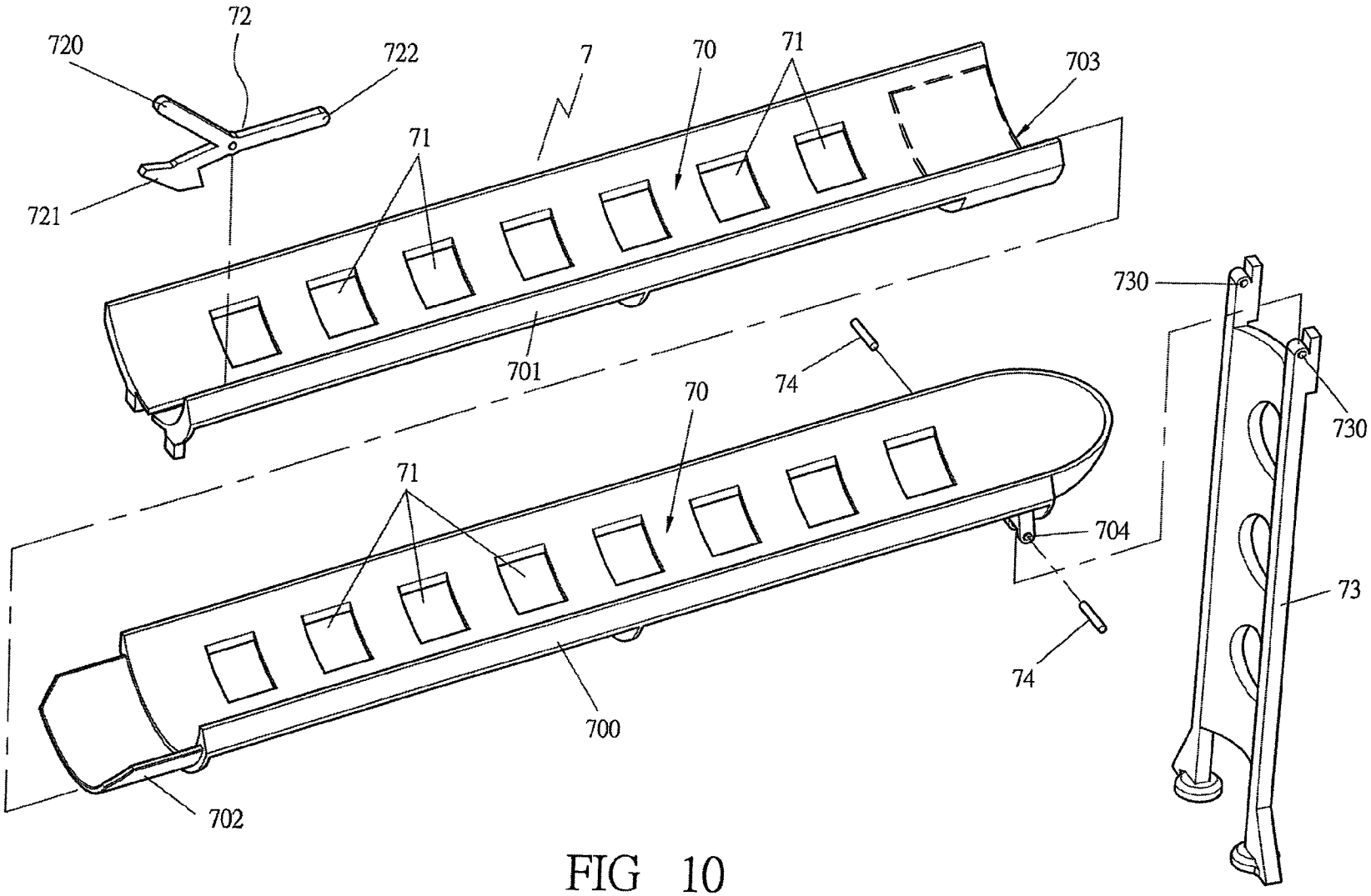
FIG. 10 is an exploded perspective view of a ball supplying device in the present invention.
Figure 11:
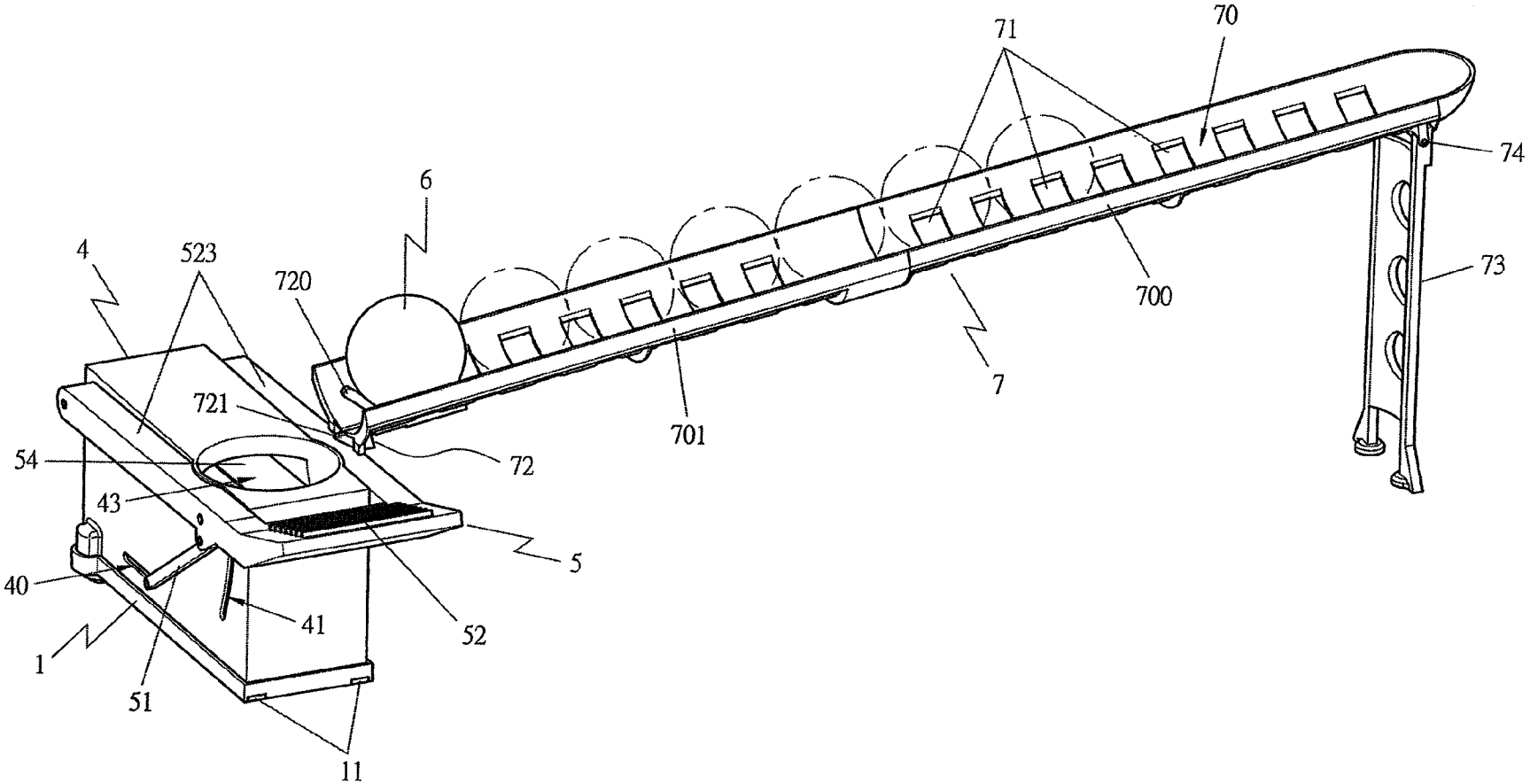
FIG. 11 is a perspective view of the baseball batting practice equipment and the ball supplying device combined together in the present invention.
Figure 12:
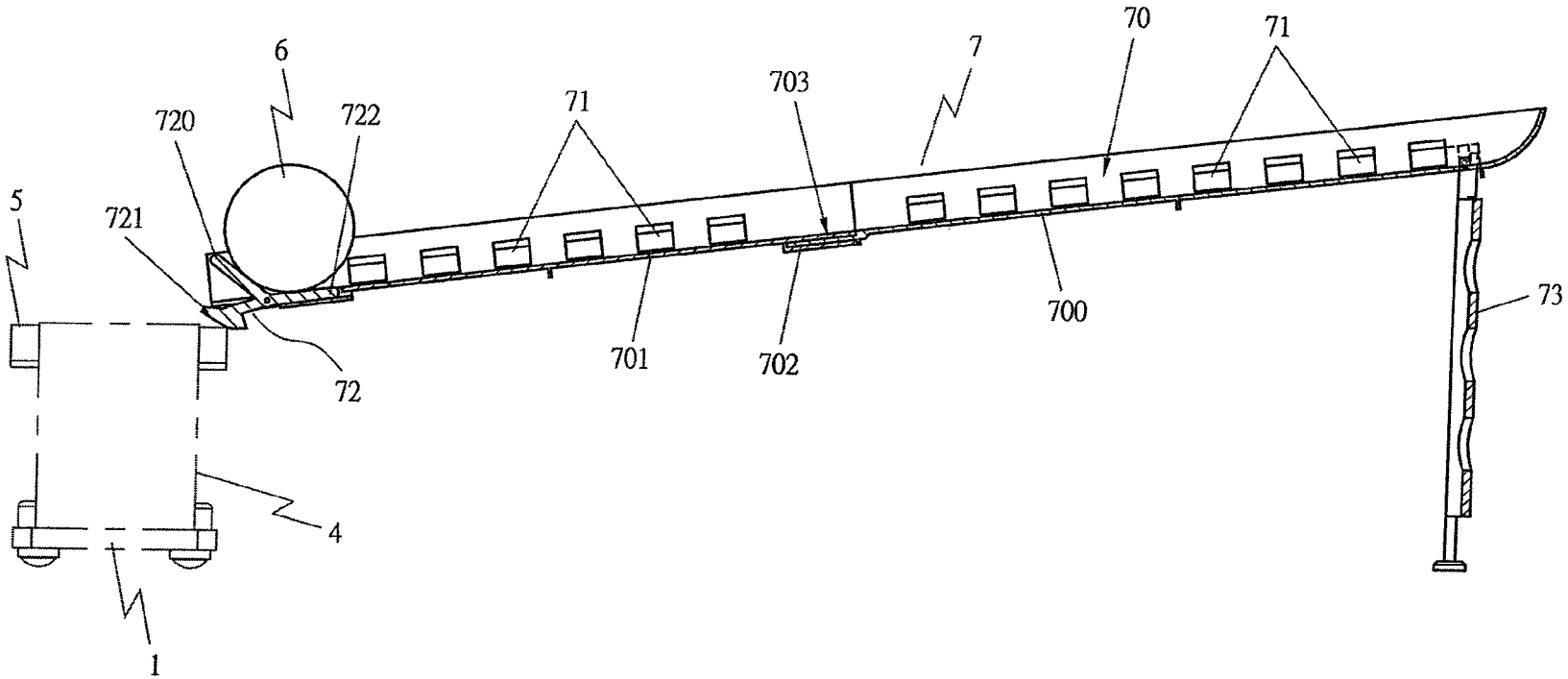
FIG. 12 is a cross-sectional view of the baseball batting practice equipment and the ball supplying device combined together in the present invention.
Figures 13, 14:
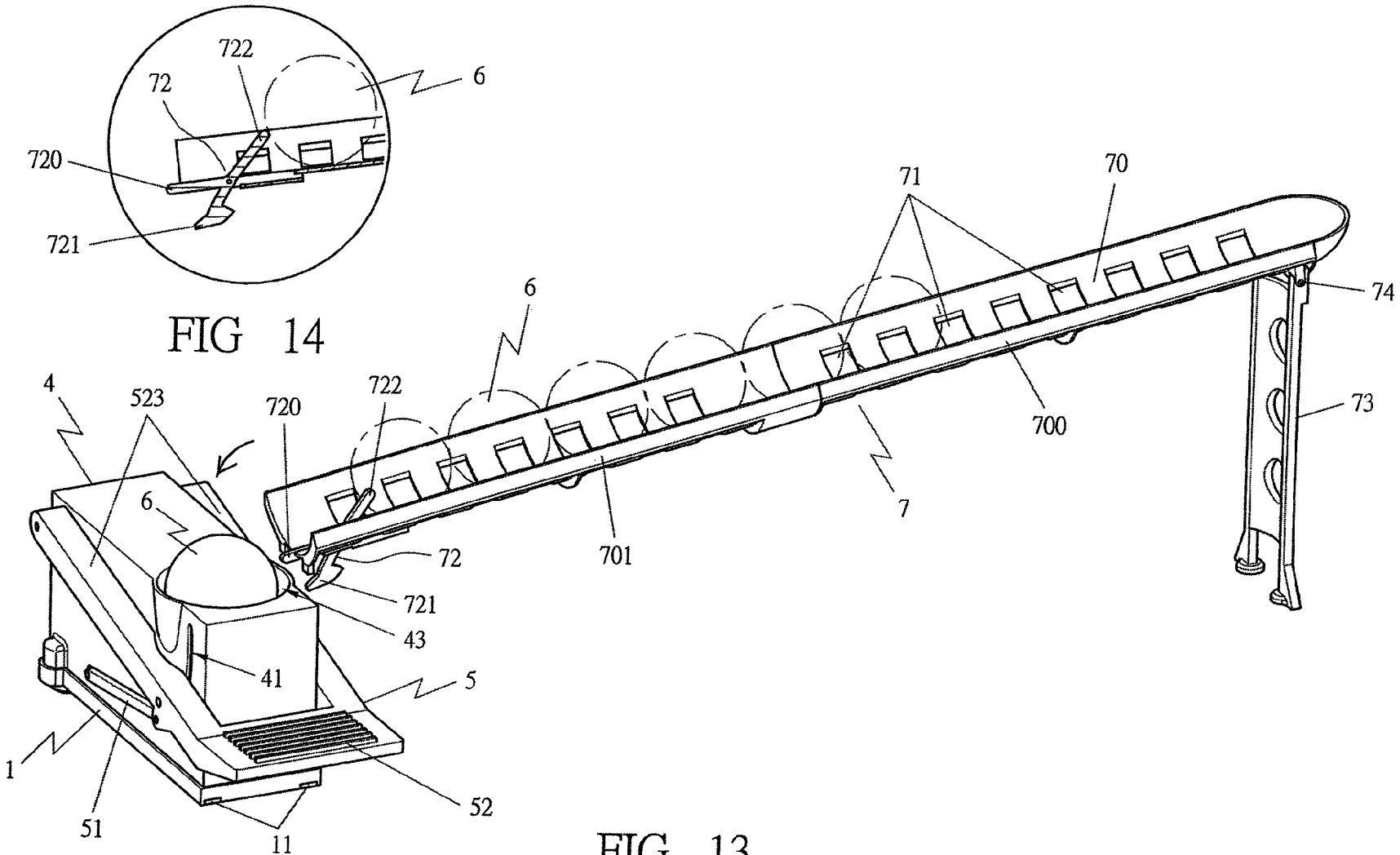
FIG. 13 is a perspective view of the ball supplying device supplying a baseball for the batting practice equipment in the present invention.
FIG. 14 is a partial cross-sectional view of the ball supplying device supplying a baseball for the batting practice equipment in the present invention.

Referring to FIGS. 10-14, the baseball batting practice equipment of this invention is additionally provided with a ball supply device 7 having a ball placing-conveying chute 70 with an inward recessing and arcuate shape to match with the shape of baseballs. The ball placing-conveying chute 70 is bored with a plurality of holes 71 for lowering the speed of downward-sliding baseballs and has its end disposed with a Y-shaped stop member 72 pivotally assembled with the ball placing-conveying chute 70 to form a seesaw condition, letting the upper end 720 of the stop member 72 function to stop a practice ball 6 from moving forward, the lower end 721 positioned on the pedal 52 and the inner end 722 set under the practice ball 6, as shown in FIG. 12. Thus, after a user treads upon the pedal 52 to let one practice ball 6 get into the ball pitching hole 43, the inner end 722 of the stop member 72 will be actuated to rise up by the weight of the lower end 721 and stop a next practice ball 6 from proceeding continuously, as shown in FIGS. 13 and 14. Moreover, the length of the ball placing-conveying chute 70 is decided in accordance with the number of practice balls 6 placed thereon at one time. FIG. 10 shows that the ball placing-conveying chute 70 consists of a first member 700 and a second member 701 to be combined together. The first member 700 has one end provided with a combining member 702 while the second member 701 has one end disposed with a combining recess 703 to be combined together with the combining member 702, thus able to lengthen the ball placing-conveying chute 70. In addition, the first member 700 has a lower side bored with a horizontal shaft hole 704 and a standing holder 73 has its opposite upper ends respectively bored with a shaft hole 730, with two pivots 74 respectively inserted in the two shaft holes 730 and the shaft hole 704 to pivotally combine the first member 700 together with the standing holder 73, thus keep the ball placing-conveying chute 70 inclined to let practice balls 6 move forward automatically and hence enable a user to practice batting continually.

While the preferred embodiment of the invention has been described above, it will be recognized and understood that various modifications may be made therein and the appended claims are intended to cover all such modifications that may fall within the spirit and scope of the invention.

I claim:

1. A baseball batting practice equipment comprising:

a base provided with a movable member having a lower side fixed with one end of an elastic member whose another end secured with said base, said elastic member helping said movable member to recover its original position, said movable member controlled to operate by a retaining post of a ball pitching speed adjusting device, said base provided with a hooking member for holding an elastic plate, said elastic plate released to pitch balls after said movable member touches said hooking member;

a ball pitching apparatus consisting of a left shell and a right shell for accommodating all members of said ball pitching apparatus, said ball pitching apparatus disposed with a spring-shaped elastic member functioning to adjust and delay time of ball pitching, said ball pitching apparatus set with a gear unit composed of a plurality of gears engaged mutually, said spring-shaped elastic member actuated to be wound tight or unwound loose by mutual operation of said gear unit together with a rack and an actuating rod, said ball pitching apparatus having a ball pitching speed adjusting device provided with a first bevel gear and a second bevel gear engaged with each other, said second bevel gear positioned in the interior of an actuating member, said actuating member formed with a protruding-out portion and a circular portion, a driving rod positioned under said actuating member and a retaining post fixed with one side of said driving rod, said retaining post having a topside assembled with an elastic member and having one side cut with a notch for said driving rod to be extended therein, said ball pitching apparatus disposed with a power unit with an actuating rod, said actuating rod inserted through one end of two connecting rods and a slot of an upper cover and through a hole of said rack, said connecting rods of said power unit having another end pivotally assembled with a shaft rod of a pedal of said power unit, and a press rod inserted through said pedal, said power unit provided with said elastic plate to be operated together with said hooking member for pitching balls; and an upper cover having a topside bored with a ball pitching hole for placing practice balls therein.

2. A baseball batting practice equipment as claimed in claim 1, wherein said base has a lower side provided with long grooves for receiving extensible plates.

3. A baseball batting practice equipment as claimed in claim 1, wherein said movable member is formed with an actuating base bored with a retaining groove to be operated with said retaining post of said ball pitching apparatus for positioning said movable member, said movable member formed with a push surface to be operated together with said hooking member, said movable member having a lower side bored with a receiving slot for fixing one end of an elastic member.

4. A baseball batting practice equipment as claimed in claim 3, wherein said movable member has one side disposed with arcuate recesses for said driving rod to operate therein.

5. A baseball batting practice equipment as claimed in claim 3, wherein said push surface of said movable member is sloped for matching said hooking member to operate together.

6. A baseball batting practice equipment as claimed in claim 1, wherein said hooking member is provided with a holding surface to be operated with said elastic plate of said ball pitching apparatus and formed with a push surface to be correspondingly operated together with said push surface of said movable member, two fixing bases respectively set at two opposite sides of said hooking member and a pivot inserted between said hooking member and said two fixing bases.

7. A baseball batting practice equipment as claimed in claim 6, wherein said two fixing bases respectively have a rear side set with a stop block for restricting turning over angles of said hooking member.

8. A baseball batting practice equipment as claimed in claim 1, wherein said left shell of said ball pitching apparatus is bored with an opening for receiving said spring-shaped elastic member and a side cover is covered on said opening and secured with two bolt seats of said left shell.

9. A baseball batting practice equipment as claimed in claim 1, wherein said gear unit is provided with a first gear having a shaft for fixing another end of said spring-shaped elastic member.

10. A baseball batting practice equipment as claimed in claim 1, wherein said first gear of said gear unit is disposed with a groove for securing said first bevel gear of said ball pitching speed adjusting device.

11. A baseball batting practice equipment as claimed in claim 1, wherein said gear unit is provided with a second gear having a pinion gear engaged with said first gear, said gear unit having a third gear with a pinion gear engaged with said second gear, said gear unit disposed with a fourth gear having a pinion gear engaged with said third gear, said gear unit provided with a slow-acting block having projections to be pushed by teeth of said fourth gear.

12. A baseball batting practice equipment as claimed in claim 11, wherein said fourth gear of said gear unit is formed with only a few teeth set apart.

13. A baseball batting practice equipment as claimed in claim 1, wherein said first bevel gear of said ball pitching speed adjusting device is formed with a groove communicating with said groove of said first gear for receiving an elastic member therein to adjust mutually engaging tightness of said first bevel gear and said second bevel gear.

14. A baseball batting practice equipment as claimed in claim 1, wherein said actuating member of said ball pitching speed adjusting device is bored with a shaft hole for receiving a long shaft, which is inverted T-shaped to be fixed with a regulating wheel.

15. A baseball batting practice equipment as claimed in claim 1, wherein said retaining post of said ball pitching speed adjusting device is positioned in an upright groove of said right shell.

16. A baseball batting practice equipment as claimed in claim 1, wherein said ball pitching apparatus is assembled between two shanks at a rear side of said pedal of said power unit and received in said upper cover.

17. A baseball batting practice equipment as claimed in claim 1, wherein said shanks of said pedal are disposed therebetween with a pivot having plural torsional elastic members mounted thereon, said pivot inserted through holes of said two shanks and two holes of said upper cover and through two holes of said ball pitching apparatus.

18. A baseball batting practice equipment as claimed in claim 1, wherein said elastic plate of said ball pitching apparatus has one end fixed at an upper side of a foundation base and a regulating block, and a long bolt is screwed between said foundation base and said regulating block for changing positions of said regulating block.

19. A baseball batting practice equipment comprising:

a base provided with a movable member, an elastic member having one end fixed at a lower side of said movable member and another end secured with said base, said elastic member assisting said movable member to recover an original position, said movable member controlled to operate by a retaining post of a ball pitching speed adjusting device, said base disposed with a hooking member for holding an elastic plate and releasing said elastic plate to pitch balls when said movable member touches said hooking member;

a ball pitching apparatus provided with a left shell and a right shell for accommodating all members of said ball pitching apparatus, said ball pitching apparatus installed with a spring-shaped elastic member for adjusting and delaying time of ball pitching, said ball pitching apparatus disposed with a gear unit composed of a plurality of gears engaged mutually, said spring-shaped elastic member actuated to be wound tight or unwound loose by mutual operation of said gear unit together with a rack and an actuating rod, said ball pitching apparatus provided with a ball pitching speed adjusting device having a first bevel gear and a second bevel gear engaged with each other, said second bevel gear assembled inside said actuating member, said actuating member formed with a protruding-out portion and a circular portion, a driving rod positioned under said actuating member and having one end fixed with a retaining post, an elastic member mounted at topside of said retaining post that is cut with a notch for one end of said driving rod to be extended therein, said ball pitching apparatus having a power unit provided with an actuating rod to be inserted through two connecting rods and a slot of an upper cover and also through an insert hole of a rack, said power unit disposed with said connecting rods respectively having one end pivotally assembled with a shaft rod of a pedal of said power unit, a press rod inserted through said pedal, said power unit provided with said elastic plate controlled by said hooking member to carry out ball pitching;

an upper cover having a topside bored with a ball pitching hole for depositing practice balls; and a ball supply device consisting of a ball placing-conveying chute having an end provided with a stop member, said stop member formed with an upper end, a lower end and an inner end.

20. A baseball batting practice equipment as claimed in claim 19, wherein said ball placing-conveying chute is inward-recessing and arcuate-shaped and disposed with a plurality of holes for lowering downward-sliding speed of said practice balls.

21. A baseball batting practice equipment as claimed in claim 19, wherein said stop member is Y-shaped.

22. A baseball batting practice equipment as claimed in claim 19, wherein said ball placing-conveying chute is composed of a first member and a second member, said first member having one end formed with a combination member to be combined together with a combination recess of said second member, said first member bored with a shaft hole matching with a shaft hole of a standing holder for pivots to be inserted therein.

* * * * *